US005973243A

United States Patent [19]

Christenson

[11] Patent Number: 5,973,243

[45] Date of Patent: Oct. 26, 1999

[54] GUITAR PICK

[76] Inventor: Eric J. Christenson, 2705 E. Camino La Zorrela, Tucson, Ariz. 85718

[21] Appl. No.: 09/035,502

[22] Filed: Mar. 5, 1998

[51] Int. Cl.[6] ..... G10D 3/16

[52] U.S. Cl. ..... 84/322

[58] Field of Search ..... 84/322, 321

[56] References Cited

U.S. PATENT DOCUMENTS

| | | | |
|---|---|---|---|
| D. 291,809 | 9/1987 | Jasper | D17/20 |
| 842,920 | 2/1907 | Thedorf | 84/322 |
| 3,699,838 | 10/1972 | Montgomery | 84/322 |
| 3,789,720 | 2/1974 | McIntyre | 84/322 |
| 4,497,237 | 2/1985 | Beall | 84/322 |
| 5,509,341 | 4/1996 | Dunlop | 84/322 |

*Primary Examiner*—Robert E. Nappi
*Assistant Examiner*—Shih-yung Hsich
*Attorney, Agent, or Firm*—Halvorson & Venable P.C.

[57] ABSTRACT

The device of the present invention is a guitar pick that is useful as a pick for stringed instruments. The device is generally worn between the two joints of middle phalange of a forefinger of a hand that is used to pluck the strings that extend over the aperture to the resonating cavity of the stringed instrument. The device has a pick portion that is attached to a ring portion. Preferably the pick portion projects from the ring portion at an angle from the plane of the ring portion. The angled projection of the pick portion from the ring portion permits a user to quickly and easily switch from picked play to finger picking play. It is conceivable that other fingers of either hand could be adorned similarly to a useful end.

7 Claims, 2 Drawing Sheets

GUITAR PICK

FIELD OF THE INVENTION

The present invention relates to the field of plectra, or as otherwise referred to, "picks"for stringed instruments such as guitars and the like.

BACKGROUND

Plectra or, as otherwise and hereafter referred to, "picks"have long been used to play stringed instruments. Typically, these picks are all similarly constructed from a resilient material, such as plastic or metal, to be flat and substantially triangular-shaped. In use, the traditional pick is gripped between the thumb and forefinger and directed across the string or strings of choice. However, the traditional guitar pick is not without infirmities.

For example, because traditional guitar picks require being gripped, there is a tendency towards being dropped. This generally happens when the musician's grip slips or becomes loosened as a result of sweat or fatigue. Furthermore, a musician may either use a pick or his fingers, commonly referred to as "finger-picking", to pluck strings. Should the musician desires to quickly alternate between "picking"with the traditional pick or "finger picking", the traditional guitar pick fails to provide the means to facilitate the musicians desire to alternate between playing styles. In an effort to address these and other problems, other practitioners in the art have disclosed related inventions.

For instance, U.S. Pat. No. 4,497,237, issued to Beall ("Beall"), discloses a pick connected to a band that wraps around the user's finger. The band is connected to the pick portion of the invention and holds the pick to the player's forefinger. Similarly, U.S. Pat. No. 3,789,720, issued to McIntyre ("McIntyre"), and Des.Pat. No. 291,809 issued to Jasper ("Jasper") also disclose guitar picks that permit wearable use. These designs feature more complete bands that wrap around the finger to hold the pick to the hand.

Unfortunately the Beall, McIntyre, and Jasper designs are somewhat complex and difficult to manufacture because each design is comprised of two or more pieces. This complexity results in increased cost that is eventually reflected in what the consumer pays. U.S. Pat. 3,699838, issued to Montgomery ("Montgomery"), presents one solution directed at this problem by disclosing an inexpensively manufactured one-piece wearable-pick.

The Montgomery patent discloses a one-piece pick constructed to fit over the end of the finger. Further, this design is easily and inexpensively stamped to the correct shape. However, because this pick is worn directly over the fingertip, or distal phalange, it may obstruct the musician's ability to play with the fingertip of the finger on which the device is worn frustrating the musician's ability to alternate between using the fingertip and the Montgomery pick.

So, while it is clear that the previously mentioned designs solve the problem associated with picks that require a thumb-forefinger grip, these designs are generally complex and relatively expensive to manufacture. On the other hand, the remaining less complex devices may obstruct the ability to play with the fingertip of the finger on which each of these devices are worn. It would instead be advantageous to construct a pick that is wearable and easily and inexpensively constructed, and that does not obstruct with the musician's ability to play with their fingertip.

SUMMARY OF THE INVENTION

It is an object of the present invention to provide a wearable guitar pick.

It is a further object of the present invention to provide a one-piece wearable guitar pick that facilitates the movement between a picking position and a finger strumming position.

It is still a further object of the present invention to provide a one-piece wearable guitar pick that is inexpensively and easily constructed.

It is yet another object of the present invention to provide a one-piece wearable guitar pick that permits unobstructed play with the fingertip of the finger on which the pick is worn, without interference to other fingers of the same hand.

It is still yet a further object of the present invention to provide a wearable guitar pick that, when worn on the finger between finger joints, facilitates the movement between a picking position and a finger strumming position.

It is still yet another object of the present invention to provide a wearable that has a picking portion that projects and is angled relative to the ring portion.

BRIEF DESCRIPTION OF THE DRAWINGS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings wherein:

DESCRIPTION OF PREFERRED EMBODIMENTS

Figure 1:
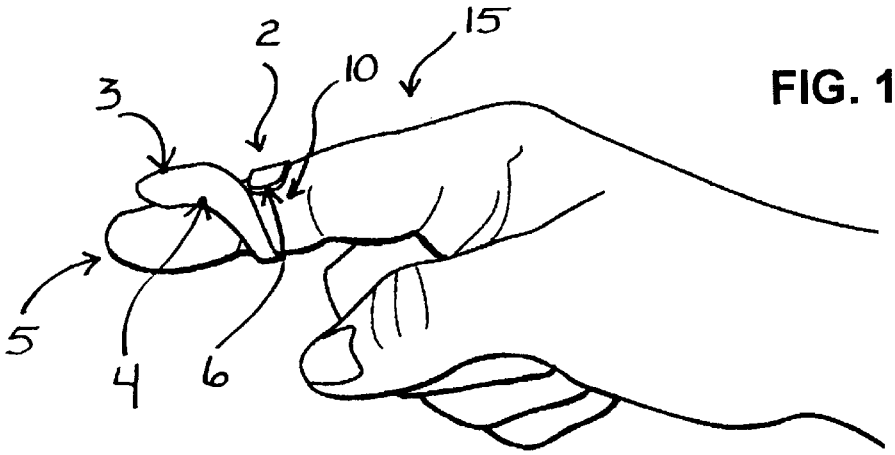
FIG. 1 shows the present invention as it is worn on the forefinger of the musician.

The device of the present invention is a guitar pick that is useful as a pick for stringed instruments. The device is generally worn between the two joints of middle phalange 10 of a forefinger 15 of a hand that is used to pluck the strings that extend over the aperture to the resonating cavity of the stringed instrument. However, it is conceivable that other fingers of either hand could be adorned similarly to a useful end. The device 1 comprises a ring-portion 2 connected to a pick-portion 3 by an angle 4 that permits unobstructed play with the fingertip 5 ("finger picking") of the finger 15 on which the device 1 is worn.

Figure 2:
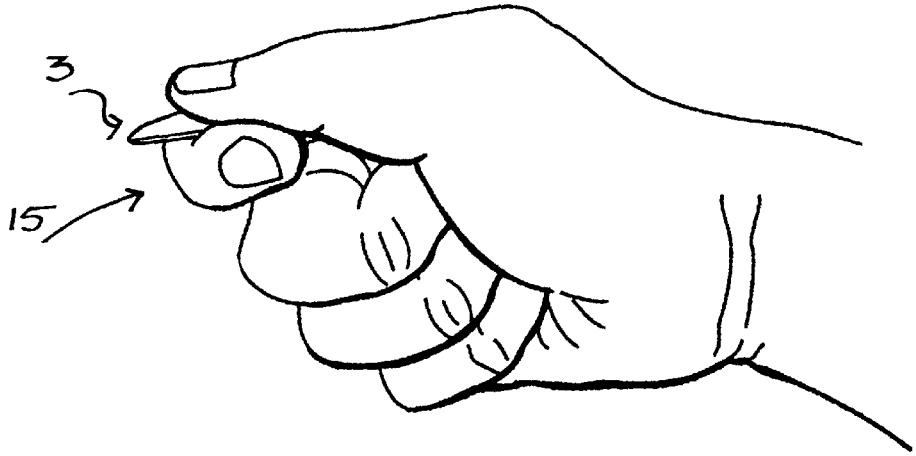
FIG. 2 shows the present invention as it is held to be used to pluck the strings of an instrument.
Figure 3:
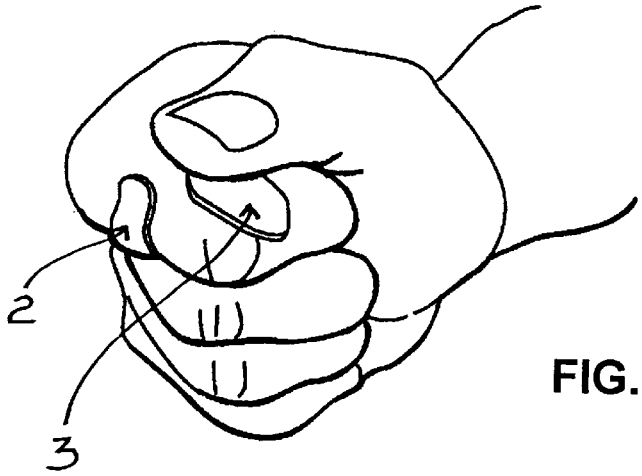
FIG. 3 shows a perspective view of the present invention as it is held to be used to pluck the strings of an instrument.
Figure 4:
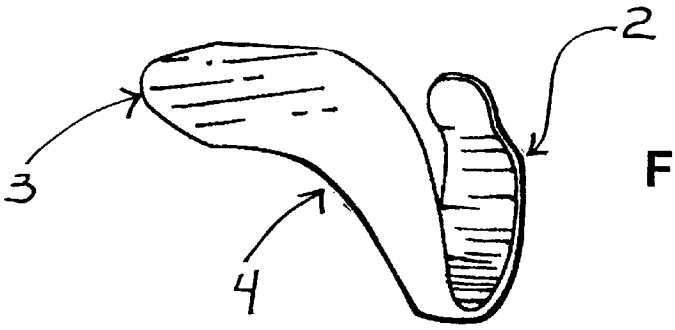
FIG. 4 shows an alternate view of the present invention.
Figure 5:
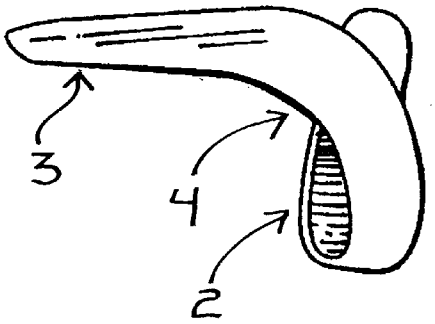
FIG. 5 shows a second alternate view of the present invention.
Figure 6:
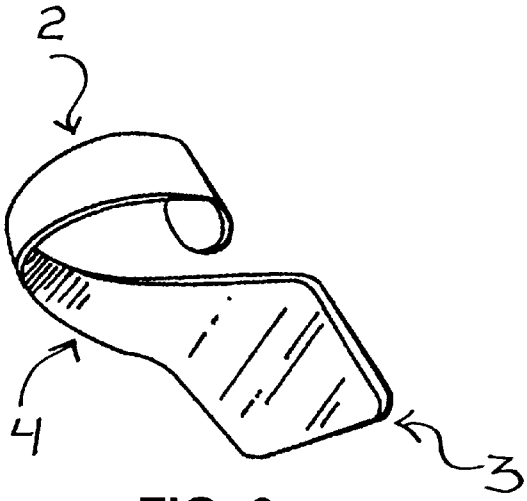
FIG. 6 shows a third alternate view of the present invention.
Figure 7:
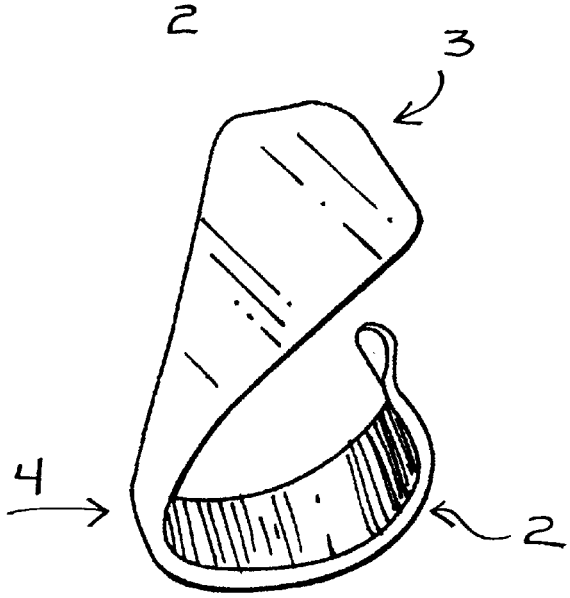
FIG. 7 shows a fourth alternate view of the present invention.
Figure 8:
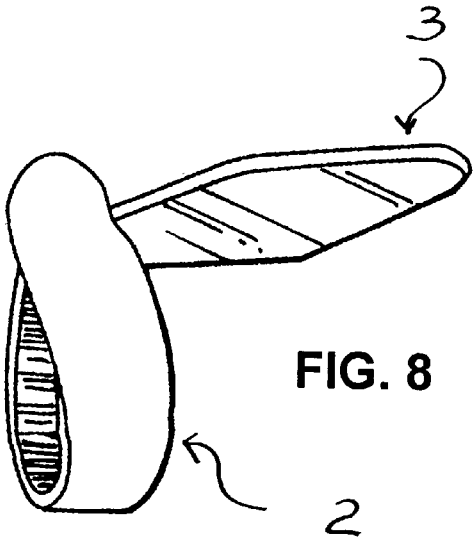
FIG. 8 shows a fifth alternate view of the present invention.

The ring-portion 2 of the present invention consists of an elongated portion of the chosen material of construction and permits the device to be worn. Since the device 1 of the present invention is intended to facilitate alternating use of the pick-portion 2 and the fingertip 5 of the finger on which the device 1 is worn, it is important that the device 1 constructed so as not to hamper the movement of the joints of the finger on which the device 1 is worn. Hence, the width of the ring-portion 2 must be smaller than the distance between the two joints of an average finger 15 between which the device is worn 1. FIGS. 1–3 depict a properly constructed and worn device.

Beyond the requirement that the ring-portion 2 not extend to hamper the joints of the phalange 10 of the forefinger 15, the exact width of the ring-portion 2 is not critical. However, enough width should be afforded the ring-portion 2 so as to maintain rigidity and provide structural integrity to the ring-portion 2. The ring-portion 2 width necessary to maintain rigidity and provide structural integrity will also depend on the strength and/or the thickness of the material chosen to construct the device 1. In an actual plastic embodiment of the present invention, a ring-portion 2 of approximately one-quarter inches wide and one-seventeenth of an inch thick was used successfully.

The exact length of the ring-portion 2 is likewise not critical. Generally it is sufficient that the ring-portion 2 be substantially the circumference of an average finger between the two joints of the middle phalange 10 of the forefinger 15. The ring-portion 2 length of between two and one-half to three inches should accommodate most fingers. Finally, the ring-portion end 6 may be tapered to affect a more comfortable fit and attractive appearance.

In a manner similar to the ring-portion 2, the overall dimensions of the pick-portion 3 are not critical. Generally, the pick-portion 3 of the present invention is relatively flat and substantially the cross-sectional area of the forefinger 15 between the last joint and the fingertip 5. It is important that the overall size of the pick-portion 3 be maintained so that unobstructed use of the present invention, and the fingertip 5 of the forefinger 15 on which the device 1 is worn is possible. Ultimately however, the pick-portion 3 can be constructed into many alternate shapes depending upon the need or playing style of the musician. FIGS. 4–8, for example, represent many alternate shapes that can be used for the pick-portion 3 of the present invention. Furthermore, the end of the pick-portion 3 that is used to strum or pick strings can be tapered or fashioned into any shape to affect a desired sound or style.

In the present invention, the ring-portion 2 connects to the pick-portion 3 by a dihedral angle 4 sufficient to permit unobstructed and alternating use of the device 1 and the fingertip 5 to which the device is attached. It is believed that most musicians will find a favored angle 4, between the range of zero (pick-portion 3 directly in line with the ring-portion 2) and less than ninety degrees (pick-portion 3 orthogonal to the ring-portion 2), measured from a horizontal axis created by an extended or straight finger. The preferred dihedral angle 4 is between fifteen and thirty degrees, or even more preferred generally twenty-two degrees. FIG. 1 shows the horizontal axis and the extended or straight finger wherein the forefinger 15 is shown pointing in the direction of the horizontal axis. FIGS. 4–8 represents several different views of the device 1.

Although the present invention can be constructed by attaching two or more separate pieces, it is preferred that the present invention be constructed from a single piece of material. Single-piece construction of the present invention is possible with metal, plastic, or the like, by using the appropriate constructing techniques.

For metal or plastic material, this might entail stamping or molding a flat piece of material to achieve an initial pre-wrapped shape of the present invention. Next, the pre-wrapped shape ring-portion 2 would be wrapped around a finger-sized cylindrical object, such as a mandrel, to fashion the final shape of the ring-portion 2. For some materials, heating the ring-portion 2 may facilitate the shaping of the ring-portion 2. The remaining material that comprises the pick-portion 3 would be left unchanged from the initial stamping or molding.

Furthermore, the desired angle 4 could be created by bending the pick-portion 3 away from the perpendicular to the horizontal axis created by the extended or straight finger. Alternately, instead of bending only the pick-portion 3 to reach the desired angle 4, the ring-portion 2 of the present invention can be wrapped in a slight spiral fashion so as to distribute the stress of bending more evenly about the entire length of the ring-portion 2 of the present invention. However, for the preferred embodiment, the desired angle 4 is stamped into the initial pre-wrapped shape and then the ring-portion 2 is wrapped into the ring-like shape shown in the figures. By stamping the desired angle 4 into the initial pre-wrapped state, it is possible to eliminate the weakness in the device 1 caused by fatiguing or deforming the material.

Ceramics, or alternately, materials such as wood and cellulose can also be used with proper construction methods clear to those ordinarily skilled in the art. Furthermore, although the drawings show the present invention constructed for right-handed musicians, it would be clear to one ordinarily skilled in the art to construct the present invention for left-handed musicians by bending or stamping the pick-portion 3 of the present invention in the alternate direction shown in the drawings.

While these descriptions directly describe the above embodiments, it is understood that those skilled in the art may conceive of modifications and/or variations to the specific embodiments shown and described herein. Any such modifications or variations that fall within the purview of this description are intended to be included therein as well. It is understood that the description herein is intended to be illustrative only and is not intended to be limitative. Rather, the scope of the invention described herein is limited only by the claims appended hereto.

What is claimed is:

1. A device for picking the strings of an instrument comprising a ring-portion attached to a pick-portion at an angle that facilitates alternating use of the pick-portion and a fingertip of a finger on which the device is worn, the angle that facilitates alternating use of the pick-portion and the fingertip of the finger on which the device is worn is between fifteen and thirty degrees, wherein said finger is not a thumb.

2. The device as in claim 1 wherein the ring-portion and the pick-portion are constructed from the same piece of material.

3. A device for picking the strings of an instrument comprising a ring-portion attached to a pick-portion at an angle that facilitates alternating use of the pick-portion and a fingertip of a finger on which the device is worn, furthermore, the angle that facilitates alternating use of the pick-portion and the fingertip of the finger on which the device is worn is between fifteen and thirty degrees.

4. The device as in claim 3 wherein the angle that facilitates alternating use of the pick-portion and a fingertip of a finger on which the device is worn is generally twenty-two degrees.

5. The device as in claim 1 wherein ring-portion is formed from an incomplete ring.

6. A device for picking the strings of an instrument comprising a ring-portion attached to a pick-portion at an angle that facilitates alternating use of the pick-portion and a fingertip of a finger on which the device is worn, said ring-portion is formed from an incomplete ring, and the angle that facilitates alternating use of the pick-portion and the fingertip of the finger on which the device is worn is between fifteen and thirty degrees.

7. The device as in claim 6 wherein the angle that facilitates alternating use of the pick-portion and a fingertip of a finger on which the device is worn is generally twenty-two degrees. and the fingertip of the finger on which the device is worn is between fifteen and thirty degrees.

* * * * *